US006749356B1

(12) United States Patent
Mead et al.

(10) Patent No.: US 6,749,356 B1
(45) Date of Patent: Jun. 15, 2004

(54) TOUCH-UP COATING APPLICATOR ASSEMBLY FOR REMOTE LOCATIONS

(75) Inventors: William T. Mead, Long Beach, CA (US); Jorge A. Millan, Lawndale, CA (US); Ralph E. Jaffke, Lakewood, CA (US); Glen Abad, Placentia, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/453,257

(22) Filed: Jun. 3, 2003

(51) Int. Cl.[7] ..... A46B 11/06; B43K 5/06

(52) U.S. Cl. ..... 401/289; 401/270; 401/176; 401/180

(58) Field of Search ..... 401/289, 270, 401/48, 176, 179, 180, 268, 205, 6; 433/80, 82, 87

(56) References Cited

U.S. PATENT DOCUMENTS 957,566 A * 5/1910 Knickerbocker ..... 4/616
1,711,352 A 4/1929 Jeffreys
3,519,364 A 7/1970 Truban ..... 401/177
4,029,422 A 6/1977 Pillsbury ..... 401/117
4,597,008 A 6/1986 Kosaka ..... 401/133
5,269,684 A 12/1993 Fischer ..... 433/90
5,984,555 A * 11/1999 Samad ..... 401/176
6,048,583 A 4/2000 Waddell ..... 427/429
6,132,126 A * 10/2000 Sheffler et al. ..... 401/213
6,422,777 B1 * 7/2002 Landrau et al. ..... 401/266

* cited by examiner

*Primary Examiner*—David J. Walczak
(74) *Attorney, Agent, or Firm*—Louis L. Dachs

(57) ABSTRACT

The invention is a coating applicator assembly for coating a structure. In detail the invention is a spring-loaded a syringe having an outlet port. A semi-flexible tube having first and second ends is coupled by its first end to the outlet port of the syringe. A coating applicator for applying the coating material to the structure in the form of brush or contoured foam.

14 Claims, 5 Drawing Sheets

FIG.6
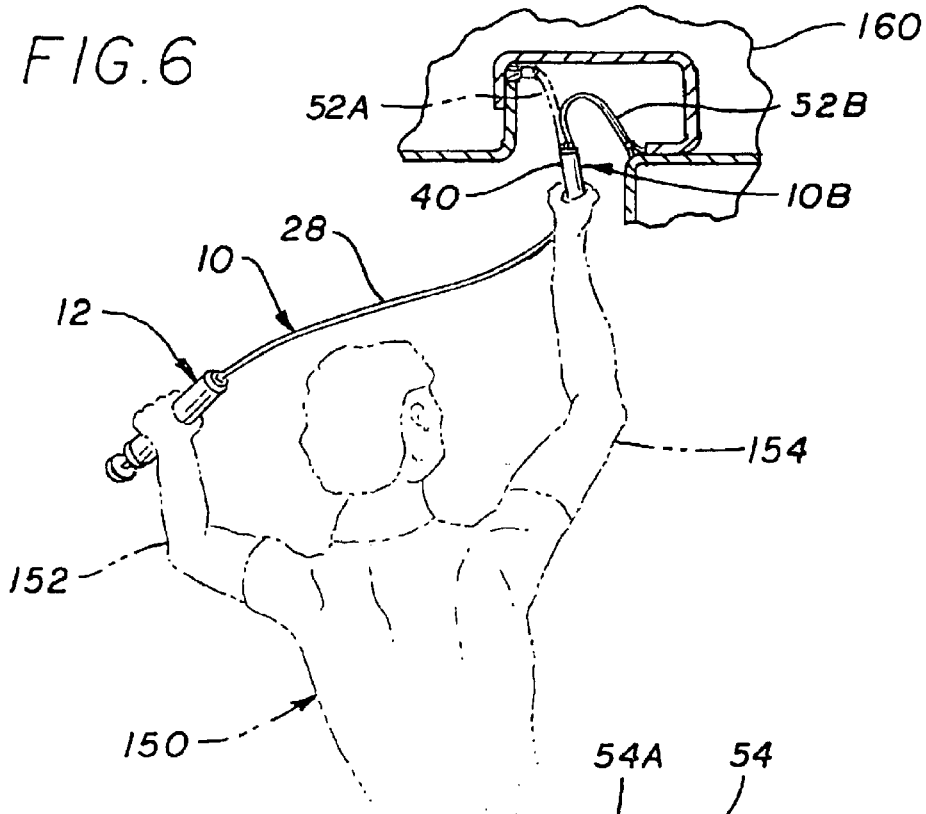
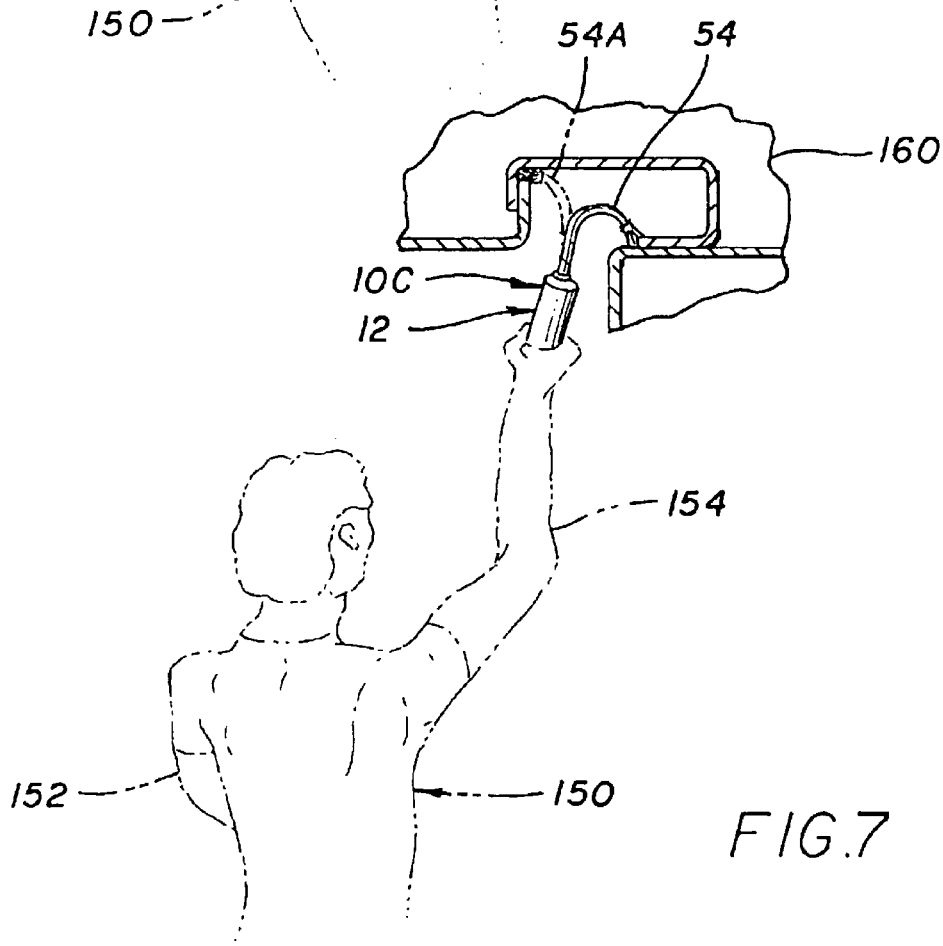
FIG.7

TOUCH-UP COATING APPLICATOR ASSEMBLY FOR REMOTE LOCATIONS

BACKGROUND OF THE INVENTION

1. Field of the Invention

The invention relates to the field of coating applicators and, in particular, to a touch-up applicator for reaching remote locations.

2. Description of Related Art

It is often necessary to touch-up previously coated structures because small areas are sometimes missed or the coating is damaged during handling. Sometimes the individual components of the structure are coated separately and are assembled with fasteners that will require protective coatings. However, touch-up after assembly requires that the coating applicator assembly be small and provide accessibility to hard to reach close out areas.

Syringe type applicators are old in the art. Examples can be found in U.S. Pat. No. 1,711,516 "Plunger Shaving Brush" by M. Alland; U.S. Pat. No. 3, 519,364 "Applicator" by A. Truhan; U.S. Pat. No. 4,029,422 "Dispenser For Air Drying A Liquid" by E. J. Pillsbury; U.S. Pat. No. 4,599,008 "Fingernail Polish Capsule And Plunger" by P. J. Furlong, et al.; and U.S. Pat. No. 5,269,684 "Adjustable Brush Delivery Tip With Secondary Flow Path" by D. E. Fischer, et al. All these applicators have a syringe and a fixed dispensing nozzle. Having a fixed dispensing nozzle limits its use to areas that have sufficient space for both the syringe and applicator nozzle and operators hands.

This problem has long been recognized. For example having a brush attached to a flexible hose connected to a reservoir of liquid is an old concept. For example, U.S. Pat. No. 6,048,583 "Method Of Applying A Liquid Protectorant" by R. L. Waddell disclosed a automobile tire coating apparatus wherein the dispensing brush, with gripping handle and actuation lever, attached by a flexible line to a tank. Of course, portable fire extinguishers have used nozzles mounted on the end of flexible tubes.

However, one of the major problems in doing touch-up coating of aircraft structures, is that the coating material must be accurately applied in a very limited space. Thus it is sometimes necessary to have the coating material container physically separated from the applicator. Furthermore, one must be able to adjust the position of applicator to reach tight positions. In addition, if the coating applicator is going to be used with two-part coating materials, containing a resin and catalyst, it is unlikely that it can be reused, thus cost becomes a factor.

Thus, it is a primary object of the invention to provide a coating applicator assembly for use in restricted areas.

It is another primary object of the invention to provide a coating applicator assembly for use in restricted areas wherein the container for the coating is located some distance from the applicator.

It is a further object of the invention to provide a coating applicator assembly for use in restricted areas wherein the applicator positioning is adjustable.

It is a still further object of the invention to provide a coating applicator assembly that is low in cost.

It is a further object of the invention to provide a non-spray applicator that does not atomize or produce hazardous air pollutants.

SUMMARY OF THE INVENTION

The invention is a coating applicator assembly for touch-up coating of a structure. In detail, the invention includes a syringe for containing the coating material of the type having a plunger at a first end for expelling the coating material out a second end. A flexible tube is coupled by its first end to the second end of syringe. A hollow handgrip is connected by a first end to second or opposite end of the flexible tube. A semi-flexible tube is coupled to its first end to the opposite or second end of the hollow handgrip. By, semi-flexible is meant that the tube can be bent into different shapes, but once bent will remain in that shape. A coating applicator is coupled to the second or opposite end of the semi-flexible tube. The coating applicator can be a brush or a foam tip of the type that can imbibe coating material and apply it to the structure.

Preferably, the syringe, flexible tube, and handle are made of plastic materials. A syringe having a 10 cubic centimeter volume is preferred because it can easily be handled using one hand. The internal diameter should of the passage way through the flexible tube and handle should be around 0.0625 inch. Of particular importance is the material used for the semi-flexible tube. Here it has been found that a semi-flexible tube is preferably made from soft metal such as aluminum, brass or copper tubing coated or covered with plastic. The internal diameter should be around 0.0625 inch with an outer diameter of 0.125 inch. The use of plastic materials will keep the manufacturing costs to a minimum. This is essential, since one of its primary applications is the dispensing of two component-coating materials. That is one containing a resin premixed with a catalyst. This requires storing at low-temperatures after loading of syringe, providing a shelf life of up to six months. Thus in many instances the syringe, flexible tubing and handle are usable after the resin sets. However, the semi-flexible tubing is recycled.

An alternate version of the invention attaches the syringe directly to the semi-flexible tube. This has the advantage of allowing one hand operation, which in certain situations can be advantageous.

In another embodiment a housing is provided having an open first end adapted to receive said syringe and a closed off second end, with the second end having an aperture there through. A valve is mounted in the second end of the housing for controlling the flow of coating material through the aperture from the syringe. The housing further includes a plunger biasing assembly that bias the plunger of the syringe toward the second end thereof. Thus when said syringe is installed in the housing, the plunger biasing assembly forces the plunger toward the second end of the syringe forcing coating material out the outlet port thereof and into the aperture in the housing. The valve controls the flow there through. Semi-flexible tube can be coupled directly to the housing or via the flexible line and handle. The use of the housing with its plunger biasing assembly and valve is far easier to use, since pressure is always available.

The novel features which are believed to be characteristic of the invention, both as to its organization and method of operation, together with further objects and advantages thereof, will be better understood from the following description in connection with the accompanying drawings in which the presently preferred embodiments of the invention are illustrated by way of examples. It is to be expressly understood, however, that the drawings are for purposes of illustration and description only and are not intended as a definition of the limits of the invention.

BRIEF DESCRIPTION OF THE DRAWINGS

FIG. 6 is a partial perspective view of an individual applying the coating material to a remote and inaccessible location using the applicator assembly shown in FIG. 2.

FIG. 7 is a partial perspective view of an individual applying the coating material to a remote and inaccessible location using the applicator assembly shown in FIG. 4.

DESCRIPTION OF THE PREFERRED EMBODIMENT

Figure 1:
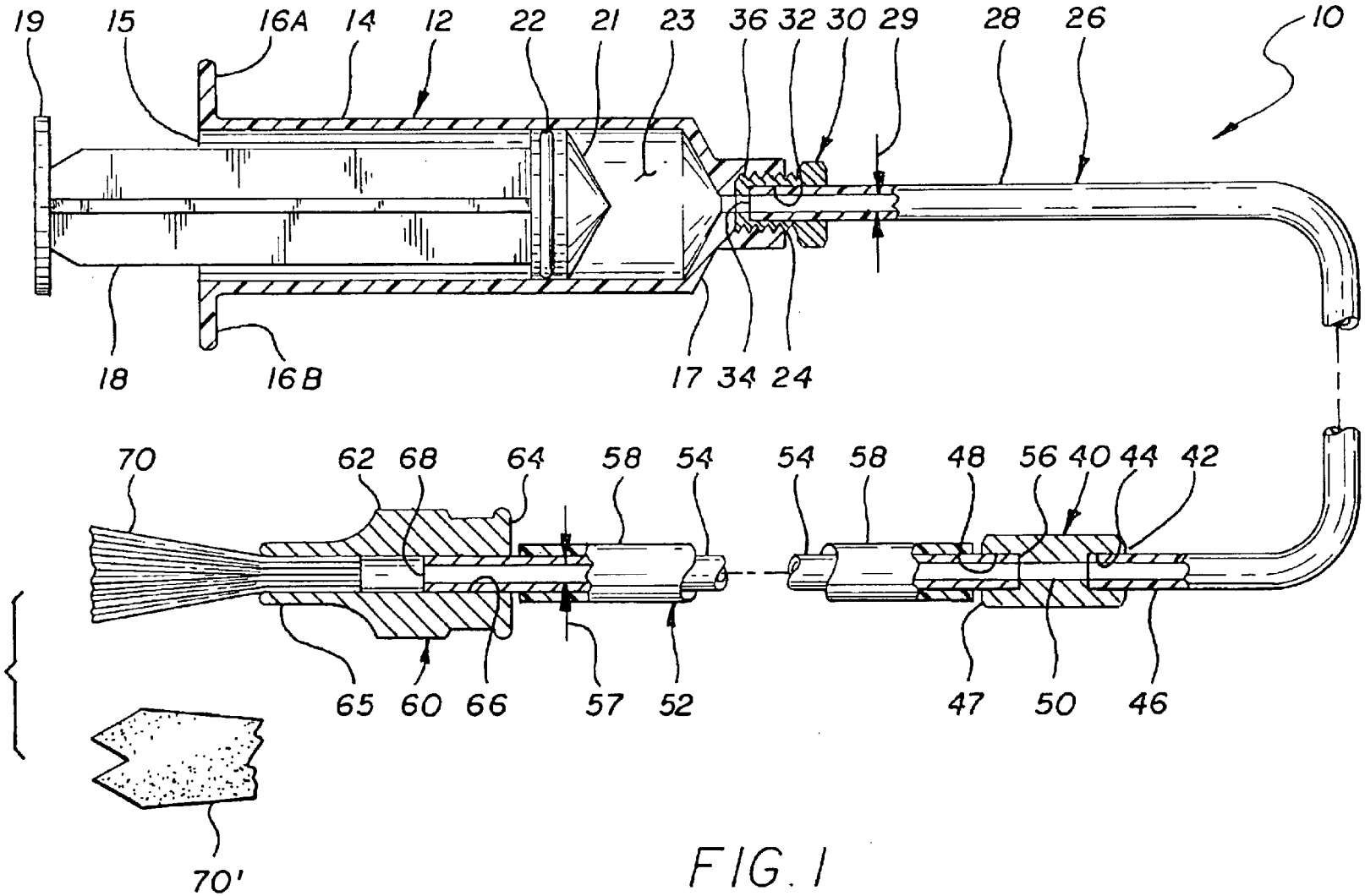
FIG. 1 is a cross-sectional view of a first version of the applicator assembly.

Referring to FIG. 1, the applicator assembly, generally indicated by numeral 10, includes a commercially available syringe 12, preferably made of plastic material. A 10 cubic centimeter capacity is ideal because it has an adequate capacity and can still be operated with one hand. The syringe 12 includes a hollow body 14 with an open first end 15 having a pair of griping arms 16A and 16B and closed off second end 17. A plunger 18 is movably mounted in the open first end 15 and terminates in a flange 19 at the external end and piston 21 within the body 14. The piston 21 includes a seal 22, which seals of the interior of the body 14. Typically, the syringe is filled with a two-part coating material 23 comprising a resin and catalyst mixed together. However, other coating materials can be used. The closed off second end 17 has a threaded hole 24 therein, in which a needle (not shown) would be normally installed.

In this case, the needle is removed and a flexible tube assembly 26 is installed. The tube assembly 26 includes a hollow flexible plastic tube 28. The length of the tube 28 can very, but a practical length is two to three feet and an internal diameter, indicated by numeral 29, of about 0.0625 inch. A fitting 30 includes a hole 32 in which the end 34 of the tube 28 is installed and bonded thereto. The fitting 30 includes an externally threaded end 36, which engages the threaded hole 24 in the syringe 12. A handle 40 includes a first end 42 having a hole 44 extending partially therein for receiving the second end 46 of the tube 28 and which is also bonded therein. The handle 40 includes a second end 47 having a hole 48 extending partially therein. A through hole 50 having a diameter of 0.625 inch connects the two holes 44 and 48. Thus the tube assembly 26 includes tube 28, fitting 30 and handle 40.

A second tube assembly 52 includes a semi-flexible tube 54 having a first end 56 inserted into the hole 48 in the second end 47 of the handle 40 and is bonded thereto. The tube 54 is preferably made of a semi-flexible metal such as aluminum, copper or brass having an internal diameter 57 also of about 0.0625 inch. The length of the second tube assembly should be between two and twelve inches. What is meant by semi-flexible is that the tube 54 can easily be bent at any angle, but is still enough to remain in the bent shape once the bending is complete. The tube 54 is coated with a plastic material 58 such as a polyvinyl chloride or similar material. A brush or foam applicator assembly 60 includes fitting 62 having a first end 64 and 1.second end 65 that includes a hole 66 there through. The second end 68 of the tube 54 extends into the hole 66 from end 64 and is bonded therein. A brush applicator 70 or foam applicator 70' is inserted into the hole 66 from end 65 of the fitting 62. Thus second tube assembly 52 includes tube 54 with plastic material 56 and brush assembly 60. In this embodiment, one hand holds the syringe 12 and the other the handle 50.

Figure 2:
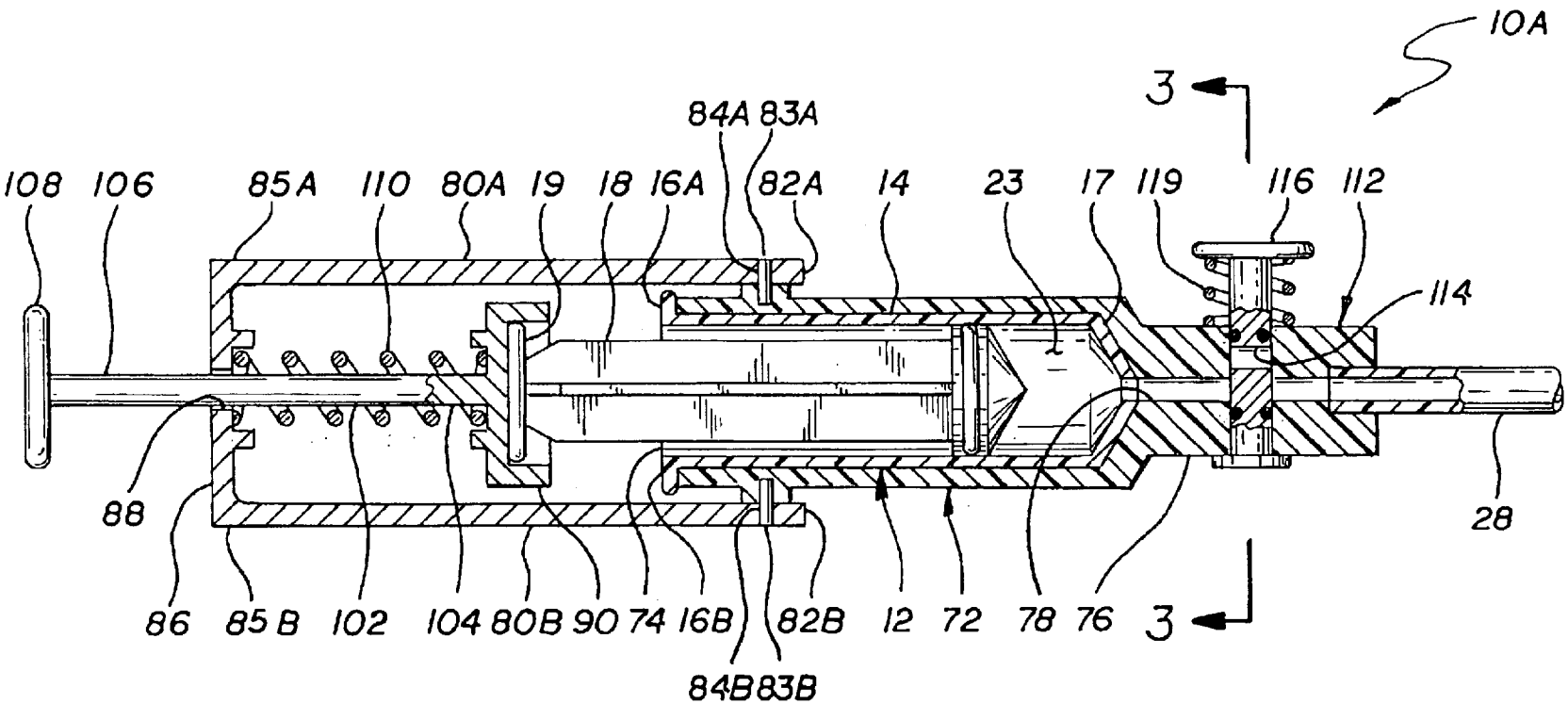
FIG. 2 is a cross-sectional view of a second embodiment of the invention.
Figure 3:
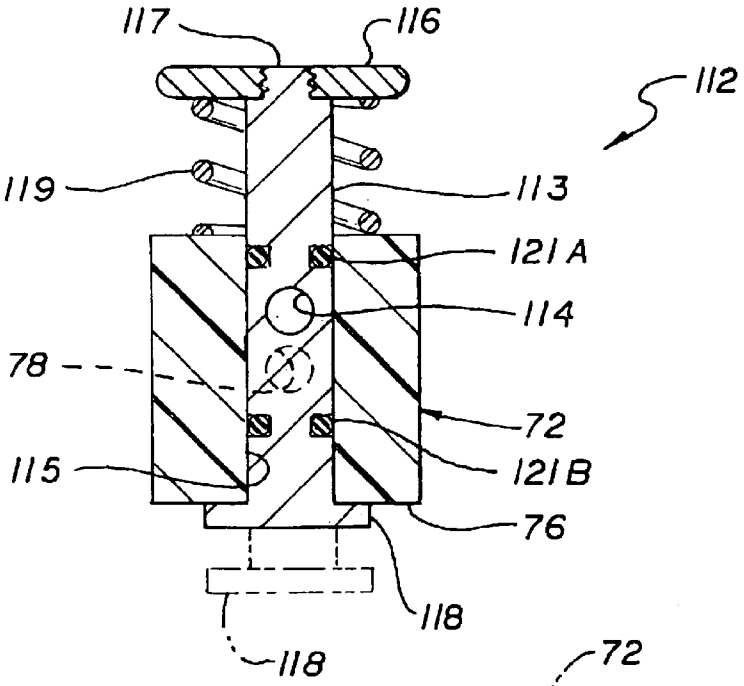
FIG. 3 is a cross-sectional view of FIG. 2 taken along the line 3—3.

In FIGS. 2 and 3, is shown an alternate embodiment of the applicator assembly, generally indicated by numeral 10A. The syringe 12 is installed in a hollow housing 72. The housing 72 has an open first end 74 and a closed off second end 76 having a hole 78 there through to which tube 28, is joined thereto by bonding or mechanical attachment. The syringe 12 is mounted within the housing 72 such that arms 16A and 16B abut the end 74 thereof. Arms, 80A and 80B, made of a semi-flexible material, are pivotally mounted by their first ends 82A and 82B to the housing 72 by means of pins 83A and 83B that engage holes 84A and 84B in the housing. The second ends 85A and 85B are connected to a spring retainer 86 having a centrally located hole 88 there through. Thus the Arms 80A and 80B can be attached to the housing 72 by bending the arms slightly outward such that the pins 83A and 83B engage the holes 84A and 84B.

A cup shaped member 90 is positioned over the flange 19 of the plunger 18. A rod 102 is connected at end 104 to the cup shaped member 90 and extends through the hole 88 in the retainer 86 and terminates at its second end 106 in a handle 108. A spring 110 is mounted between the member 90 and retainer 86 biasing the plunger 18 toward the second end 17 of the body 14 tending to expel the coating material 23. The handle 108 prevents the cup shaped member 90, rod 102 and spring 110 from separating from the retainer 86 when the syringe 12 is removed form the housing 72.

A valve 112 is mounted in the second end 76 of the housing 72 for controlling flow of the coating material 23 out of the hole 78. The valve 112 is a simple design having a shaft 113 with a hole 114 there through movably mounted in hole 115 in the housing 72. The shaft 113 is threadably attached to a button 116 at end 117 and includes a flange 118 at its opposite end. A spring 119 biases the shaft upward so that hole 114 is out of alignment with hole 78 in the housing 72. 0-rings 121A and 121B seal the shaft 113 so that coating material cannot escape from the housing. Pressing down on the button 116 will cause the hole 114 in the shaft 113 to align with the hole 78 allowing the coating material 23 to flow into tube 28. The advantage of this embodiment is that with the coating material 23 under pressure, the operator provides material control and need only press the button 116 to cause flow.

Figure 4:
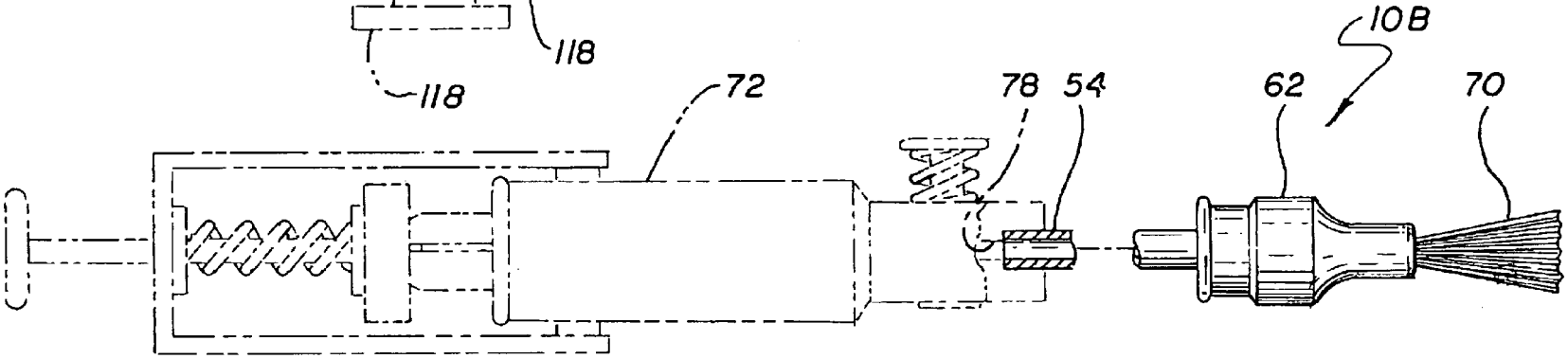
FIG. 4 is a cross-sectional view of a third embodiment of the invention.

In a third embodiment, illustrated in FIG. 4 and generally indicated by numeral 10B, the tube assembly 52 is joined directly to the housing 76. This is accomplished by bonding end 56 of the tube 54 to the hole 78 of the housing 72. This configuration has the advantage of being able to apply a coating to a part with using only one hand. However, the single hand must be used to simultaneously position the brush applicator 70 while actuating the button 116.

Figure 5:
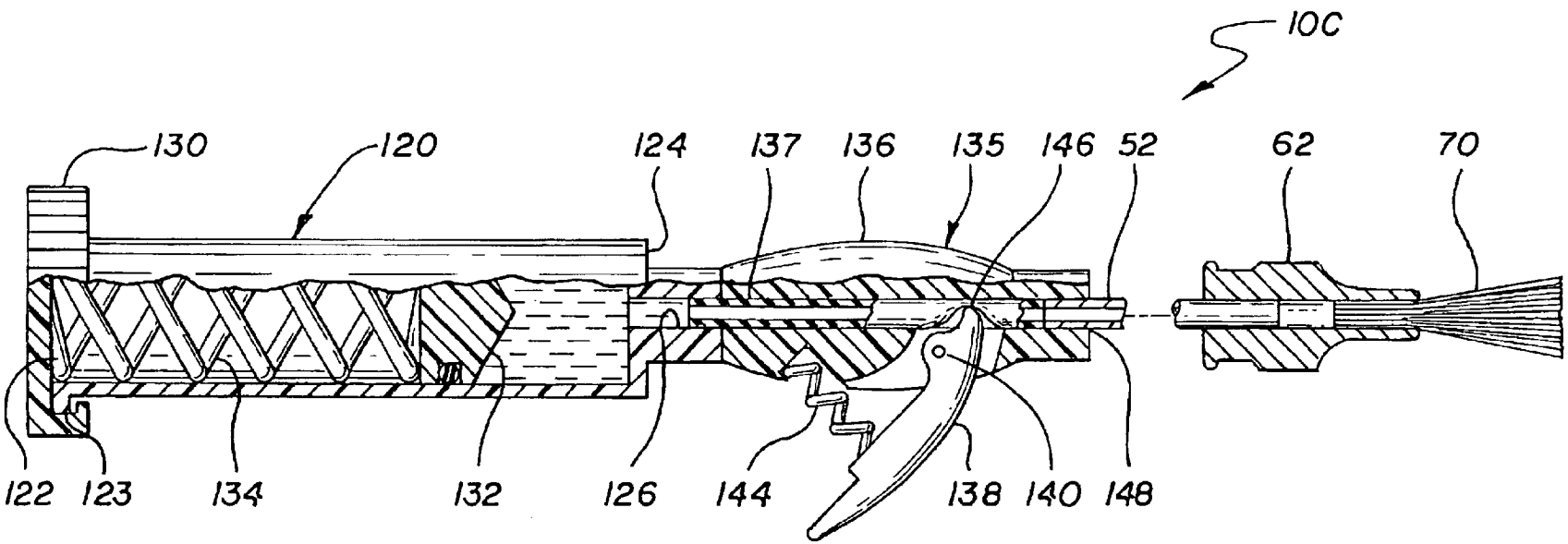
FIG. 5 is a cross-sectional view of a fourth embodiment of the invention.

A fourth embodiment of the applicator assembly is illustrated in FIG. 5, and generally indicated by numeral 10C. The Applicator assembly 10C includes a syringe 120 that includes an open first end 122 having a flange 123 and a closed off second end 124 having an aperture 126 therein. The syringe 120 includes a twist on cap 130, which locks on to the flange 123. A piston 132 is movably mounted within the syringe 120 biased toward the second end 124 by spring 134 positioned between it and the cap 130. Thus, coating material 23 is pushed toward the aperture 126. A valve 135 includes a body 136 incorporating a plastic tube 137. A handle 138 is pivotally mounted to the body 136 and rotates about pivot axis 140. The handle 138 is biased by spring 144 such that a protrusion 146 on the handle normally crimps the tube 137 closing it off. When the handle 138 is pushed toward the body 136 the protrusion 146 disengages from the tube 137 allowing flow there through.

The output port 148 of the valve 135 is connected to the tube 52, which of course, delivers coating material to the brush 70. This embodiment, with automatic feed can more easily be operated with one hand. The valve depicted is a TS102D Dispensing Pen, manufactured by Techcon Systems, Garden Grove, Calif.; however, there are numerous other types of valves that can be used.

In FIG. 6 an individual, indicated by numeral 150 is shown using applicator assembly 10 shown in FIG. 1. One hand 152 holds and operates the syringe 12, while the other hand 154 holds the handle 40. Having a flexible tube 28 and semi-flexible tube 52, the applicator assembly 10 can be used in difficult to reach areas of a complex aircraft structure 160. For purposes of illustration, the semi-flexible tube 52 is shown bent into two configurations 52A and 52B. In FIG. 7, the individual 150 is illustrated holding the applicator assembly 10B, shown in FIG. 2, in one hand 154 and easily apply a coating. The choice of which applicator to use will be depend upon individual operator preference and the remoteness of the location where the coating must be applied. One of the main advantages of these applicator assemblies is that they are very inexpensive to manufacture. Thus when using them with prior mixed two part (resin and catalyst) coating materials, one time usage would not pose an unacceptable economic burden.

While the invention has been described with reference to a particular embodiment, it should be understood that the embodiment is merely illustrative, as there are numerous variations and modifications, which may be made by those skilled in the art. Thus, the invention is to be construed as being limited only by the spirit and scope of the appended claims.

INDUSTRIAL APPLICABILITY

The invention has applicability to coating and paint industries

What is claimed is:

1. An applicator assembly for coating a structure with a coating, material comprising;

a syringe having plunger for expelling coating material out an outlet port;

a semi-flexible tube having first and second ends;

coupling means for joining said first end of said semi-flexible tube to said outlet port of said syringe, said coupling means comprising;

a flexible tube having a first end coupled to the output port of said syringe, said flexible tube having a second end; and a hollow handgrip having a first end coupled to said second end of said flexible tube, said hollow handgrip having a second end connected to said semi-flexible tube; and a coating applicator for applying the coating material to the structure mounted to said second end of said semi-flexible tube.

2. The coating applicator assembly as set forth in claim 1 wherein said semi-flexible tube is made of a flexible metal with a plastic cover.

3. The coating applicator assembly as set forth in claim 1 wherein said syringe has a capacity of approximately 10 cubic centimeters.

4. The coating applicator assembly as set forth in claim 3 where said semi-flexible tube has an internal diameter of approximately 0.062-inch.

5. The coating applicator as set forth in claim 1 wherein said coupling means comprises;

a housing having an open first end adapted to receive said syringe and a closed off second end, said second end having an aperture there through;

a valve mounted in said second end of said housing for controlling the flow of coating material through said aperture in said second end of said housing; and plunger biasing means to bias said plunger of said syringe toward said second end thereof;

such that when said syringe is installed in said housing, said plunger biasing means forces said plunger toward said second end of said housing forcing coating material out said outlet port thereof and into said aperture and said valve controlling the flow there through.

6. The coating applicator as set forth in claim 5 wherein said coupling means comprises:

a flexible tube having a first end coupled to said aperture of said housing, said flexible tube having a second end; and a hollow handgrip having a first end coupled to said second end of said flexible tube, said hollow handgrip having a second end connected to said semi-flexible tube.

7. The coating applicator assembly as set forth in claim 6 wherein said semi-flexible tube is made of a flexible metal with a plastic cover.

8. The coating applicator assembly as set forth in claim 7 wherein, said syringe has a capacity of approximately 10 cubic centimeters.

9. The coating applicator assembly as set forth in claim 8 where said semi-flexible tube has an internal diameter of approximately 0.062-inch.

10. A coating applicator assembly for coating a structure comprising:

a syringe for containing the coating material, said syringe having a plunger at a first end for expelling the coating material out a second end;

a flexible tube having a first end coupled to the second end of said syringe said flexible tube having a second end;

a hollow handgrip having a first end coupled to said second end of said flexible tube, said hollow handgrip having a second end;

a semi-flexible tube having a first end coupled to said second end of said hollow hand grip, said semi-flexible tube having a second end; and a coating applicator coupled to said second end of said semi-flexible tube, said coating applicator adapted to imbibe coating material and apply it to the structure.

11. The coating applicator assembly as set forth in claim 10 wherein said semi-flexible tube is made of a metal.

12. The coating applicator assembly as set forth in claim 11 wherein said semi-flexible tube is made of a flexible metal with a plastic cover.

13. The coating applicator assembly as set forth in claim 12 wherein said syringe has a capacity of approximately 10 cubic centimeters.

14. The coating applicator assembly as set forth in claim 13 where said semi-flexible tube has an internal diameter of approximately 0.062 inch.

* * * * *